US012729492B2

(12) United States Patent
Oetken et al.

(10) Patent No.: US 12,729,492 B2
(45) Date of Patent: Sep. 8, 2026

(54) SYSTEM AND METHOD FOR DETERMINING COMPACTION OF WORK SURFACE

(71) Applicant: Caterpillar Paving Products Inc., Brooklyn Park, MN (US)

(72) Inventors: Nicholas Alan Oetken, Brooklyn Park, MN (US); Allen John DeClerk, Princeton, IL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 67 days.

(21) Appl. No.: 18/828,236

(22) Filed: Sep. 9, 2024

(65) Prior Publication Data

US 2026/0071393 A1 Mar. 12, 2026

(51) Int. Cl.
*E01C 19/28* (2006.01)

(52) U.S. Cl.
CPC ..... *E01C 19/288* (2013.01)

(58) Field of Classification Search
None
See application file for complete search history.

(56) References Cited

U.S. PATENT DOCUMENTS 6,188,942 B1 2/2001 Corcoran et al.
7,394,354 B2 7/2008 Yu
7,428,455 B2 9/2008 Corcoran
9,222,226 B2 12/2015 Villwock et al.
10,166,826 B2 1/2019 Gray
10,690,579 B2 6/2020 Laugwitz
2008/0267719 A1* 10/2008 Corcoran ..... E02D 3/039 405/271
2016/0237630 A1* 8/2016 Aho ..... E01C 19/288
2019/0301109 A1* 10/2019 Roberts ..... G01S 13/885
2023/0020213 A1* 1/2023 Commuri ..... E01C 19/288
2023/0071823 A1* 3/2023 Owston ..... A01D 41/127
2023/0220645 A1* 7/2023 Doy ..... E01C 19/282 404/133.05

* cited by examiner

*Primary Examiner* — Arslan Azhar

(57) ABSTRACT

A system for determining compaction of a work surface. The system includes a first frame, and a second frame pivotally coupled to the first frame at an articulated joint. The system includes a first traction unit operatively coupled to the first frame and configured to compact the work surface and a second traction unit operatively coupled to the second frame and configured to propel the second frame over the work surface. The system includes a force sensor positioned at the articulated joint and configured to measure a force transferred between the first frame and the second frame. The system includes a controller configured to determine, based on the force, a first compaction level of a first region of the work surface in rolling engagement with the first traction unit and a second compaction level of a second region of the work surface in rolling engagement with the second traction unit.

20 Claims, 6 Drawing Sheets

SYSTEM AND METHOD FOR DETERMINING COMPACTION OF WORK SURFACE

TECHNICAL FIELD

The present disclosure relates to compaction of work surfaces. More particularly, the present disclosure relates to a system and a method for determining compaction of a work surface based on a force at an articulated joint of a compactor machine.

BACKGROUND

Compactors are known for compacting work surface materials (such as soil, gravel, asphalt, landfill trash) to a desired density or stiffness while constructing a worksite such as highways, parking lots, and other structures. A compactor typically includes a first frame supported on the work surface via a first traction unit (e.g., a front compaction drum), a second frame supported on the work surface via a second traction unit (e.g., rear pneumatic wheels), and an articulated joint pivotally connecting the first frame to the second frame.

A machine drive power (MDP) system is used for determining a compaction level (indicative of stiffness or density) of the work surface. For instance, the MDP system measures a total power required to propel the compactor machine over the work surface, and accordingly estimates the compaction level of the work surface based on the measured total power. During operation, the compactor may traverse regions with varying densities or stiffness across the worksite. For instance, the material under the front compaction drum may be softer or stiffer compared to the material under the rear pneumatic wheels at a particular location. Such variations may lead to inaccuracies in estimating the compaction level and in the precise mapping of regions with different densities (or stiffnesses), which may affect the working efficiency of the compactor.

United States Patent Publication No. 2008/0267719 discloses a compaction determination system for monitoring the compaction in a material produced by a rotary device as the rotary device is towed over the material. The compaction determination system may have a force sensor associated with a drawbar used to tow the rotary device, the force sensor being configured to sense a force transmitted to the rotary device via the drawbar. The compaction determination system may further have a controller in communication with the force sensor. The controller may be configured to determine a compaction of the material produced by the rotary device based on the sensed force.

SUMMARY OF THE INVENTION

In an embodiment, the present disclosure relates to a system for determining compaction of a work surface. The system includes a first frame, and a second frame pivotally coupled to the first frame at an articulated joint. The system further includes a first traction unit operatively coupled to the first frame and configured to compact the work surface via rolling engagement with the work surface. The system further includes a second traction unit operatively coupled to the second frame and configured to propel the second frame over the work surface via rolling engagement with the work surface. The system includes a force sensor positioned at the articulated joint. The force sensor is configured to measure a force transferred between the first frame and the second frame through the articulated joint. The system further includes a controller configured to determine, based on the force, a first compaction level of a first region of the work surface in rolling engagement with the first traction unit and a second compaction level of a second region of the work surface in rolling engagement with the second traction unit.

In another embodiment, the present disclosure relates to a compactor including a power source configured to power movement of the compactor on a work surface for compaction of the work surface. The compactor includes a system for determining compaction of a work surface. The system includes a first frame, and a second frame pivotally coupled to the first frame at an articulated joint. The second frame configured to support the power source. The system further includes a first traction unit operatively coupled to the first frame and configured to compact the work surface via rolling engagement with the work surface. The system further includes a second traction unit operatively coupled to the second frame and configured to propel the second frame over the work surface via rolling engagement with the work surface. The system includes a force sensor positioned at the articulated joint. The force sensor is configured to measure a force transferred between the first frame and the second frame through the articulated joint. The system further includes a controller configured to determine, based on the force, a first compaction level of a first region of the work surface in rolling engagement with the first traction unit and a second compaction level of a second region of the work surface in rolling engagement with the second traction unit.

In yet another embodiment, the present disclosure relates to a method for determining compaction of a work surface using a first frame, a second frame pivotally coupled to the first frame at an articulated joint, a first traction unit operatively coupled to the first frame and configured to compact the work surface via rolling engagement with the work surface, and a second traction unit operatively coupled to the second frame and configured to propel the second frame over the work surface via rolling engagement with the work surface. The method includes measuring, by a force sensor positioned at the articulated joint, a force transferred between the first frame and the second frame through the articulated joint. The method further includes determining, by a controller, based on the force, a first compaction level of a first region of the work surface in rolling engagement with the first traction unit and a second compaction level of a second region of the work surface in rolling engagement with the second traction unit.

DETAILED DESCRIPTION

Reference will now be made in detail to specific embodiments or features, examples of which are illustrated in the accompanying drawings. Wherever possible, the same reference numbers will be used throughout the drawings to refer to the same or the like parts.

Figure 1:
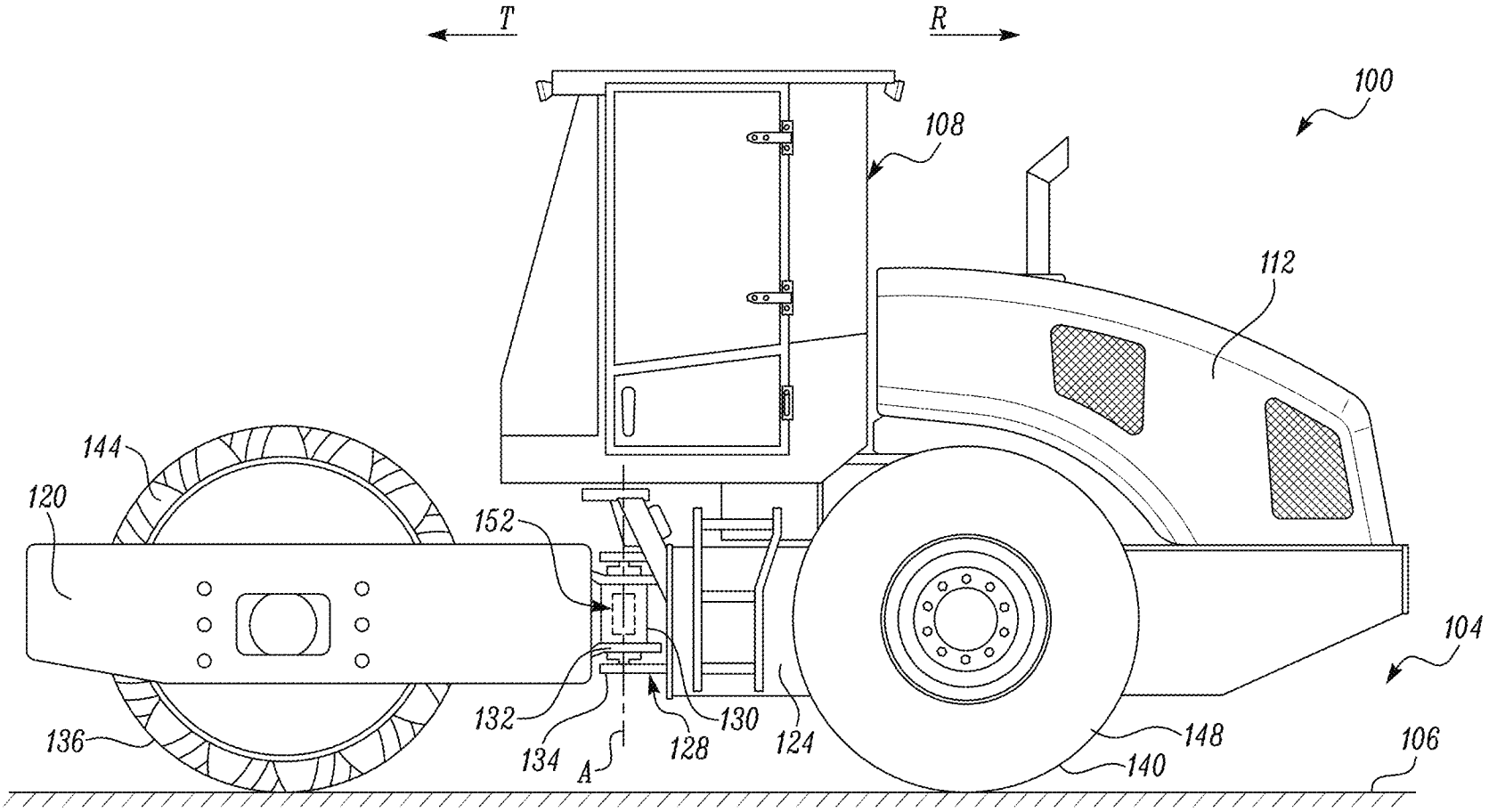
FIG. 1 is a side view of a compactor traversing a work surface.

Referring to FIG. 1, an exemplary compactor 100 is disclosed. The compactor 100 may be operable at a worksite 104 having a work surface 106 for performing a variety of compaction operations. As shown, the compactor 100 is a soil compactor for compacting various soils. In other embodiments, the compactor 100 may be a landfill compactor, asphalt paving compactor, or any other type of compactors. The work surface 106 may include soil, gravel, landfill waste, asphalt, combinations thereof, or any other surface material known in the art to benefit from a compaction process.

The compactor 100 may include a cab or an operator station 108 configured to accommodate an operator of the compactor 100. The compactor 100 may further include a power source 112 configured to power movement of the compactor 100 on the work surface 106 for compaction of the work surface 106. The power source 112 may include a combustion engine, a gas turbine, or any other prime mover known in the art. In some embodiments, the power source 112 may be an electric power source and may include battery systems, fuel cells, and the like.

Further, the compactor 100 includes a first frame 120 and a second frame 124 coupled to the first frame 120 via an articulated joint 128. The first frame 120 and the second frame 124 may be coupled together by a pivot shaft 130 of the articulated joint 128. For example, the first frame 120 may include a first yoke 132 and the second frame 124 may include a second yoke 134. The first yoke 132 of the first frame 120 may be coupled to the second yoke 134 of the second frame 124 via the pivot shaft 130. The articulated joint 128 may be configured to enable a rotational degree of freedom between the first frame 120 and the second frame 124 about an axis 'A' that may extend perpendicular to a traveling direction, T, of the compactor 100. In addition, the articulated joint 128 may be configured to transmit propulsion force between the first frame 120 and the second frame 124 either along the traveling direction, T, or in a rearward direction, R, opposite the traveling direction, T.

The compactor 100 may further include a first traction unit 136 and a second traction unit 140. The first traction unit 136 may be operatively coupled to the first frame 120 and configured to compact the work surface 106 via rolling engagement with the work surface 106. The first traction unit 136 may include a compaction drum 144. The compaction drum 144 may be coupled to the power source 112 to transfer mechanical power from the power source 112 to the compaction drum 144 to propel the compaction drum 144 over the work surface 106. The compaction drum 144 may include a vibratory compaction mechanism. A circumferential surface of the compaction drum 144 may be a smooth surface, a textured surface, such as that on a tipped drum, or any other compaction drum surface structure known in the art.

The second traction unit 140 may be operatively coupled to the second frame 124 and configured to propel the second frame 124 over the work surface 106 via rolling engagement with the work surface 106. The second traction unit 140 may include a propulsion device 148. The propulsion device 148 is operatively coupled to the power source 112 for transfer of mechanical power from the power source 112 to the propulsion device 148 to propel the compactor 100 over the work surface 106. The propulsion device 148 may include one or more pneumatic tires, a compaction drum, a track drive, a belt drive, or any other land-based propulsion device known in the art.

Figure 2:
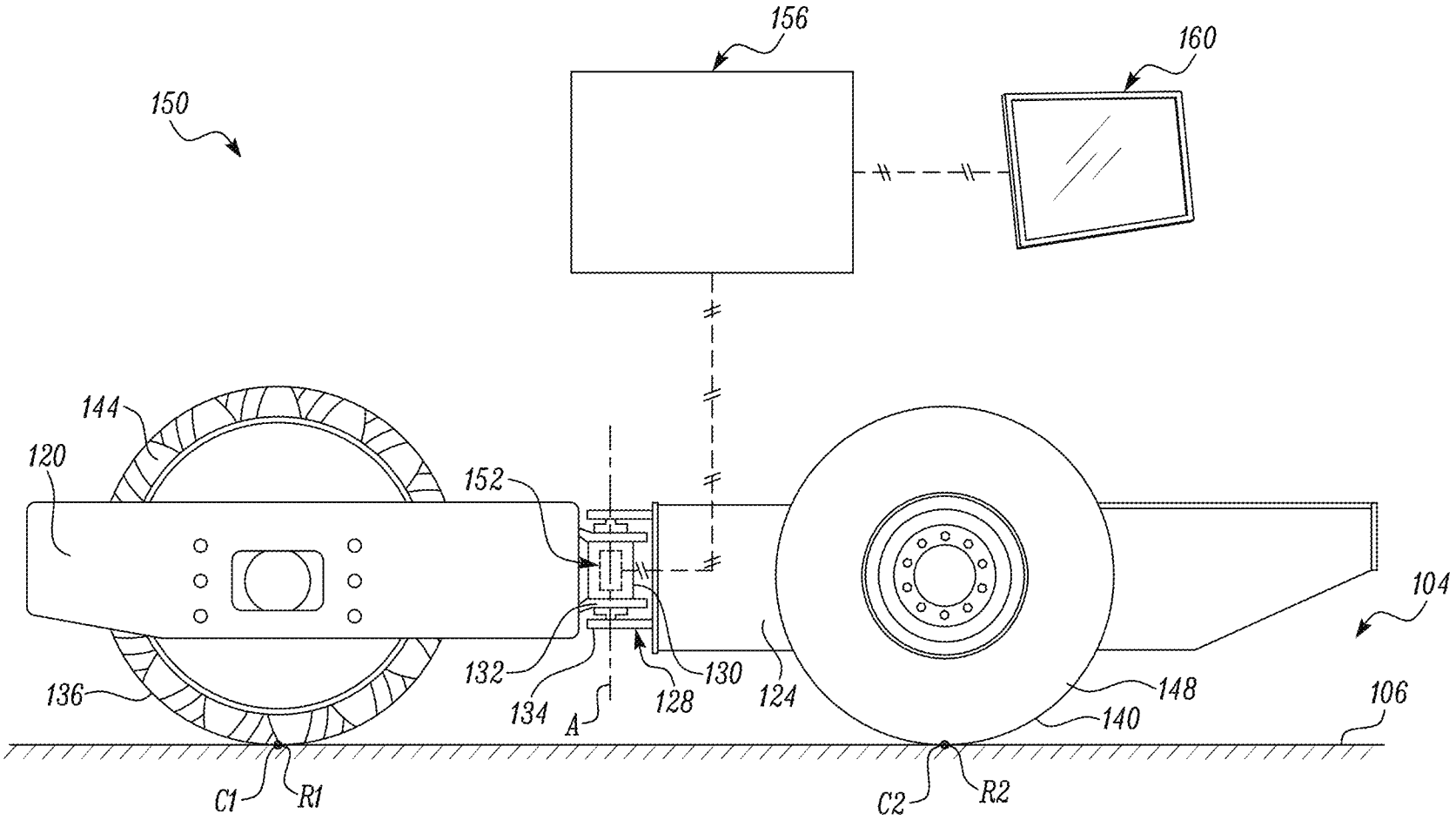
FIG. 2 is a schematic view of a system for determining compaction of a work surface.

Referring to FIG. 2, the compactor 100 further includes a system 150 for determining compaction of the work surface 106. The system 150 facilitates determination of a force, F, transferred between the first frame 120 and the second frame 124 when the compactor 100 is traversing the worksite 104. Further, the system 150 facilitates determination of the compaction level of surfaces beneath the first traction unit 136 and the second traction unit 140 at a particular location of the compactor 100 traversing the worksite 104, based on the force, F. For instance, the system 150 facilitates determination of a first compaction level, $C_1$, of a first region $R_1$ (of the work surface 106) defined beneath the first traction unit 136 and in rolling engagement with the first traction unit 136, and a second compaction level, $C_2$, of a second region, $R_2$, (of the work surface 106) defined beneath the second traction unit 140 and in rolling engagement with the second traction unit 140. The first compaction level, $C_1$, of the first region, $R_1$, may indicate stiffness of the first region, $R_1$, in rolling engagement with the first traction unit 136, and the second compaction level, $C_2$, of the second region, $R_2$, may indicate stiffness of the second region, $R_2$, in rolling engagement with the second traction unit 140. Accordingly, the system 150 facilitates accurate mapping of the compaction state of the worksite 104. To this end, the system 150 includes a force sensor 152 and a controller 156. The system 150 may further include a display 160. The display 160 may be present inside the operator station 108. In some embodiments, the display 160 may be present at a remote workstation. The force sensor 152 and the controller 156 are discussed below in detail.

The force sensor 152 is positioned at the articulated joint 128. In some embodiments, the force sensor 152 may be incorporated into the pivot shaft 130 of the articulated joint 128. The force sensor 152 is configured to measure a force, F, transferred between the first frame 120 and the second frame 124 through the articulated joint 128. The force sensor 152 may be subjected to the entirety of force transferred through the articulated joint 128, and a signal from the force sensor 152 may be indicative of the entirety of the force being transferred through the articulated joint 128. In some embodiments, the force sensor 152 may be subjected to only a portion of the force transferred through the articulated joint 128, and the total force transfer through the articulated joint 128 may be determined based on the signal from the force sensor 152, calibration data, a physics-based model of force transfer through the articulated joint 128, or combinations thereof.

In some embodiments, the force, F, may correspond to a zero value. In such a scenario no force is being transferred between the first frame 120 and the second frame 124 through the articulated joint 128. In some embodiments, the force, F, may correspond to a non-zero value. In such a scenario, the force is transferred between the first frame 120 and the second frame 124 through the articulated joint 128. In some embodiments, the force sensor 152 may provide a positive or a negative value of the force, F. For example, if the force, F, is positive, the second frame 124 may exert a force on the first frame 120. Further, if the force, F, is negative, the first frame 120 may exert a force on the second frame 124.

The controller 156 may include a computing device having a single microprocessor or multiple microprocessors. For example, the controller 156 may include a memory, a secondary storage device, a clock, and a processing hardware, one or more of which may be used, in concert with another part of the controller 156, for accomplishing a task as discussed below in the present disclosure. The controller 156 may be configured to receive inputs (e.g., electrical signals) from one or more components of the compactor 100, process the inputs, and generate output signals based on the date inputs and/or the processed data.

The controller 156 is communicably coupled to the force sensor 152 and the display 160. The controller 156 is configured to receive signals (from the force sensor 152) corresponding to the force, F, transferred between the first frame 120 and the second frame 124 through the articulated joint 128.

Based on the signal indicative of the force, F, transferred between the first frame 120 and the second frame 124 through the articulated joint 128, the controller 156 is configured to determine the compaction of the work surface 106, i.e., the first compaction level, $C_1$, of the first region, $R_1$, of the work surface 106 and the second compaction level, $C_2$, of the second region, $R_2$, of the work surface 106. To this end, the controller 156 may be configured to obtain a first parameter indicative of a current drive power, $P_1$, of the first traction unit 136, and a second parameter indicative of a current drive power, $P_2$, of the second traction unit 140. In one example, the controller 156 may obtain calculated values of the first parameter and the second parameter from a machine ECM (not shown) associated with the compactor 100. In another example, in which the controller 156 is the same as the machine ECM, the controller 156 may calculate the first parameter and the second parameter based on mechanical power delivered to each of the first traction unit 136 and the second traction unit 140, and a current travelling speed of the compactor 100.

Based on the first parameter, the second parameter, and the force, F, the controller 156 may be configured to calculate a first machine drive power, $MDP_1$, required to propel the first traction unit 136 over the work surface 106 and a second machine drive power, $MDP_2$, required to propel the second traction unit 140 over the work surface 106. In an embodiment, the controller 156 may calculate the first machine drive power, $MDP_1$, and the second machine drive power, $MDP_2$, when the current drive power, $P_1$ (of the first traction unit 136) is equal to the current drive power, $P_2$ (of the second traction unit 140). The controller 156 may calculate the first machine drive power, $MDP_1$, and the second machine drive power, $MDP_2$, by utilizing one or more physics-based models and/or mathematical equations, known in the art.

Based on the first machine drive power, $MDP_1$, and the second machine drive power, $MDP_2$, the controller 156 may be configured to correspondingly estimate the first compaction level, $C_1$, (of the first region, $R_1$) and the second compaction level $C_2$, (of the second region, $R_2$). In an example, the controller 156 may utilize a map (pre-stored in a memory of the controller 156) correlating the machine drive power and the compaction level of the work surface 106.

In a first exemplary scenario in which the controller 156 may receive a signal (from the force sensor 152) corresponding to a zero value of the force, F, transferred between the first frame 120 and the second frame 124 through the articulated joint 128, the controller 156 may calculate and determine the first machine drive power, $MDP_1$, to be equal to the second machine drive power, $MDP_2$. In response, the controller 156 may estimate the first compaction level $C_1$, (of the first region, $R_1$) to be equal to the second compaction level $C_2$, (of the second region, $R_2$). Accordingly, the controller 156 may determine that the stiffness (or density) of the first region, $R_1$ (of the work surface 106) may be equal to the stiffness (or density) of the second region, $R_2$ (of the work surface 106). Simultaneously, the controller 156 may estimate the first compaction level, $C_1$, (of the first region, $R_1$) and the second compaction level $C_2$, (of the second region, $R_2$) based on the calculated first machine drive power, $MDP_1$, and the second machine drive power, $MDP_2$.

In a second exemplary scenario in which the controller 156 may receive a signal (from the force sensor 152) corresponding to a first non-zero value (e.g., a positive non-zero value) of the force, F, transferred between the first frame 120 and the second frame 124 through the articulated joint 128, the controller 156 may calculate and determine the first machine drive power, $MDP_1$, to be greater than the second machine drive power, $MDP_2$. In response, the controller 156 may estimate the first compaction level $C_1$, (of the first region, $R_1$) to be lower than the second compaction level $C_2$, (of the second region $R_2$). Accordingly, the controller 156 may determine that the stiffness (or density) of the first region, $R_1$ (of the work surface 106) is lower than the stiffness (or density) of the second region, $R_2$ (of the work surface 106).

In a third exemplary scenario in which the controller 156 receive a signal (from the force sensor 152) corresponding to a second non-zero value (e.g., a negative non-zero value) of the force, F, transferred between the first frame 120 and the second frame 124 through the articulated joint 128, the controller 156 may calculate and determine the first machine drive power, $MDP_1$, to be lesser than the second machine drive power, $MDP_2$. In response, the controller 156 may estimate the first compaction level $C_1$, (of the first region, $R_1$) to be higher than the second compaction level $C_2$, (of the second region $R_2$). Accordingly, the controller 156 may determine that the stiffness (or density) of the first region, $R_1$ (of the work surface 106) is higher than the stiffness (or density) of the second region, $R_2$ (of the work surface 106).

Additionally, in some embodiments, the controller 156 may be configured to receive an input indicative of a location of the rolling engagement of the first traction unit 136 with the first region, $R_1$, of the work surface 106. The location of the first traction unit 136 with the first region, $R_1$, of the work surface 106 may be determined by using a GNSS (Global Navigation Satellite System) sensor (not shown) mounted on the first traction unit 136. Further, the controller 156 may be configured to generate a stiffness map for the work surface 106 based on the first compaction level, $C_1$, the second compaction level $C_2$, and the input indicative of the location of the rolling engagement of the first traction unit 136 with the first region, $R_1$, of the work surface 106. The stiffness map may be displayed to the operator of the compactor 100 by using the display 160. The operator may use the stiffness map to identify regions of the work surface 106 which has a stiffness lesser/greater than the predefined threshold and may take action for working on that region. In some embodiments, the controller 156 may generate the stiffness map in real-time based on the compaction level of different regions of the work surface 106. This may help the operator to perform the compaction of the work surface 106 with uniformity.

Although it is discussed that the GNSS sensor is used to determine the location of the first traction unit 136, it may be contemplated that, in other embodiments, any other suitable systems/sensors may be used to determine the location of the first traction unit 136. Further, in some embodiments, the controller 156 may also determine the location of the second traction unit 140 by using the location of the first traction unit 136.

INDUSTRIAL APPLICABILITY

Figure 5:
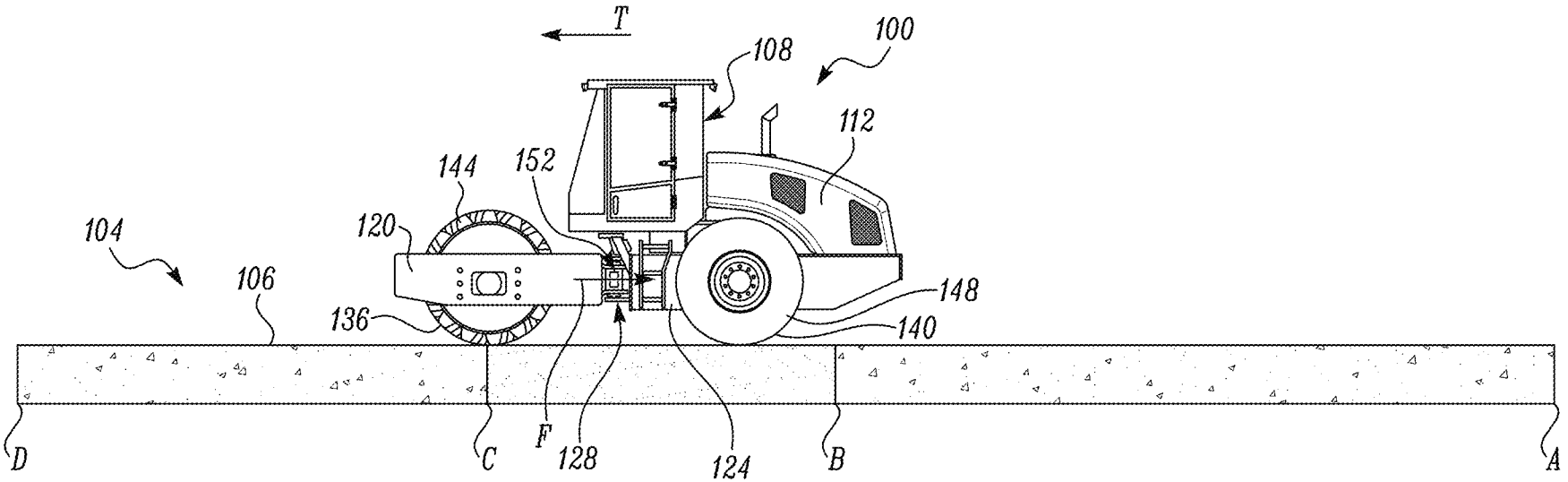
Figure 6:
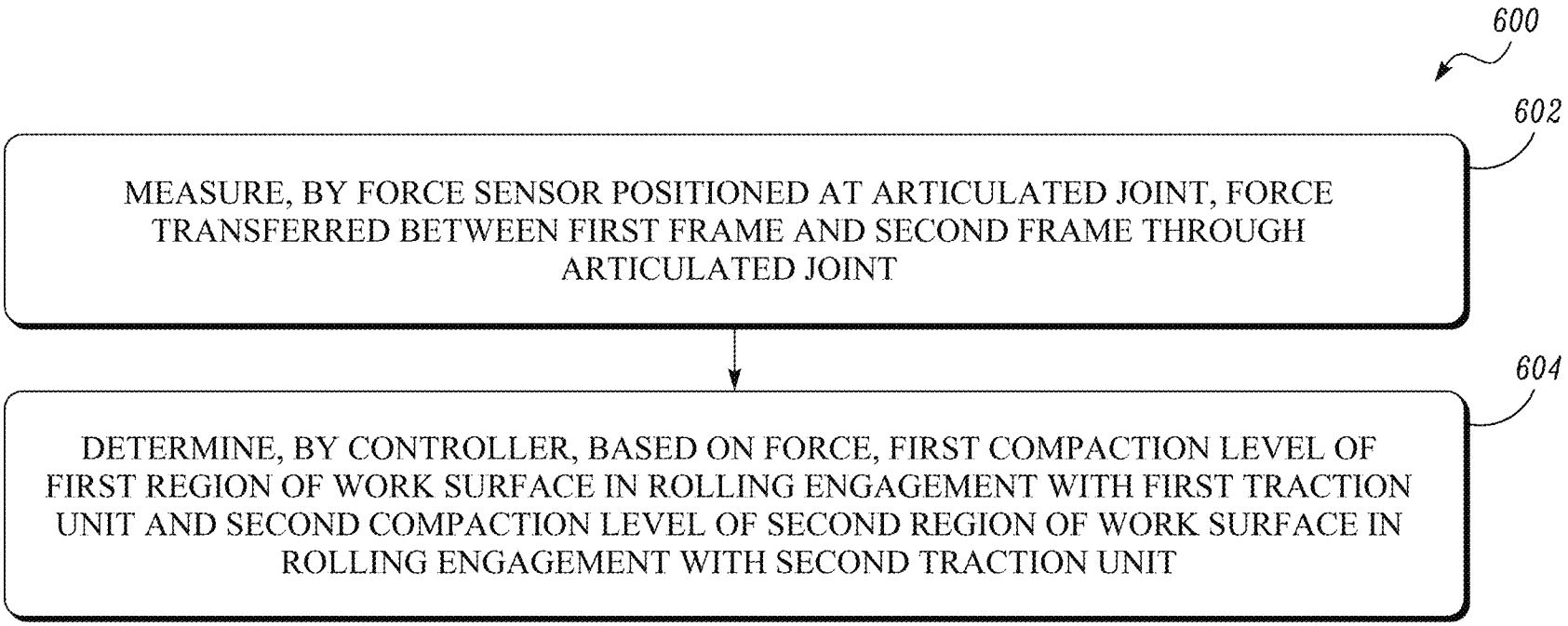
FIG. 6 is a flow chart depicting a method for determining compaction of a work surface.

Referring to FIG. 6, an exemplary method of determining method for determining compaction of a work surface 106 by using the system 150, is discussed. The method is discussed by way of a flowchart 400 that illustrates exemplary stages (e.g., from 602 to 604) associated with the method. The method is also discussed in conjunction with FIGS. 3-5. It will be appreciated that the order of steps described in the method is exemplary in nature and that the steps can be performed in a different order than what is set out below, as will be contemplated by a person skilled in the art based on the description of the present disclosure.

Figure 3:
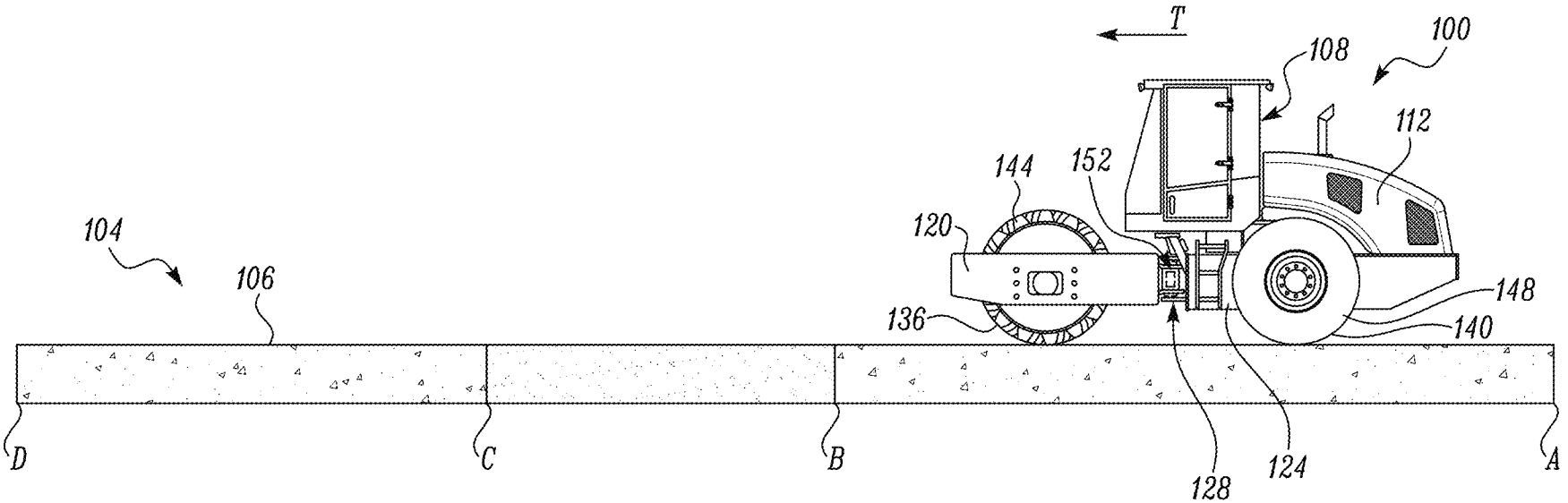
FIGS. 3-5 illustrate a compactor traversing a work surface having varying stiffness levels.

In an exemplary operation, the compactor 100 may traverse along the traveling direction, T, on the work surface 106, from point 'A' towards point 'B', as shown in FIG. 3. At this point, the current drive power, $P_1$, of the first traction unit 136 may be equal to the current drive power, $P_2$, of the second traction unit 140. The force sensor 152, positioned at the articulated joint 128, measures the force, F, transferred between the first frame 120 and the second frame 124 (at step 602). At this point, the force sensor 152 measures the force, F, to be equal to zero, i.e., no force is transferred between the first frame 120 and the second frame 124 through the articulated joint 128. Simultaneously, the force sensor 152 may transmit a signal corresponding to the force, F, to the controller 156.

The controller 156 may receive the signal corresponding to the zero value of the force, F. In response to the zero value of the force, the controller 156 may determine that a region (i.e., the first region) of the work surface 106 in rolling engagement with the first traction unit 136 has a stiffness similar to a stiffness of a region (i.e., the second region) of the work surface 106 in rolling engagement with the second traction unit 140. Simultaneously, the controller 156 determines the compaction levels of the regions in rolling engagement with their corresponding first traction unit 136 and the second traction unit 140, i.e., the first compaction level, $C_1$, of the first region and the second compaction level $C_2$, of the second region, based on the force, F, at step 604.

For that, the controller 156 may obtain the first parameter indicative of the current drive power, $P_1$, of the first traction unit 136, and the second parameter indicative of a current drive power, $P_2$, of the second traction unit 140. Based on the first parameter, the second parameter, and the force, F, the controller 156 may calculate the first machine drive power, $MDP_1$, required to propel the first traction unit 136 over the first region (of the work surface 106) and the second machine drive power, $MDP_2$, required to propel the second traction unit 140 over the second region (of the work surface 106). The controller 156 may use one or more physics-based models and/or mathematical equations, known in the art, to calculate the first machine drive power, $MDP_1$, and the second machine drive power, $MDP_2$. Based on the first machine drive power, $MDP_1$, and the second machine drive power, $MDP_2$, the controller 156 may estimate the first compaction level, $C_1$, of the first region and the second compaction level $C_2$, of the second region. At this stage, the controller 156 determines the first compaction level, $C_1$, (of the first region) and the second compaction level $C_2$, (of the second region) to be equal.

Figure 4:
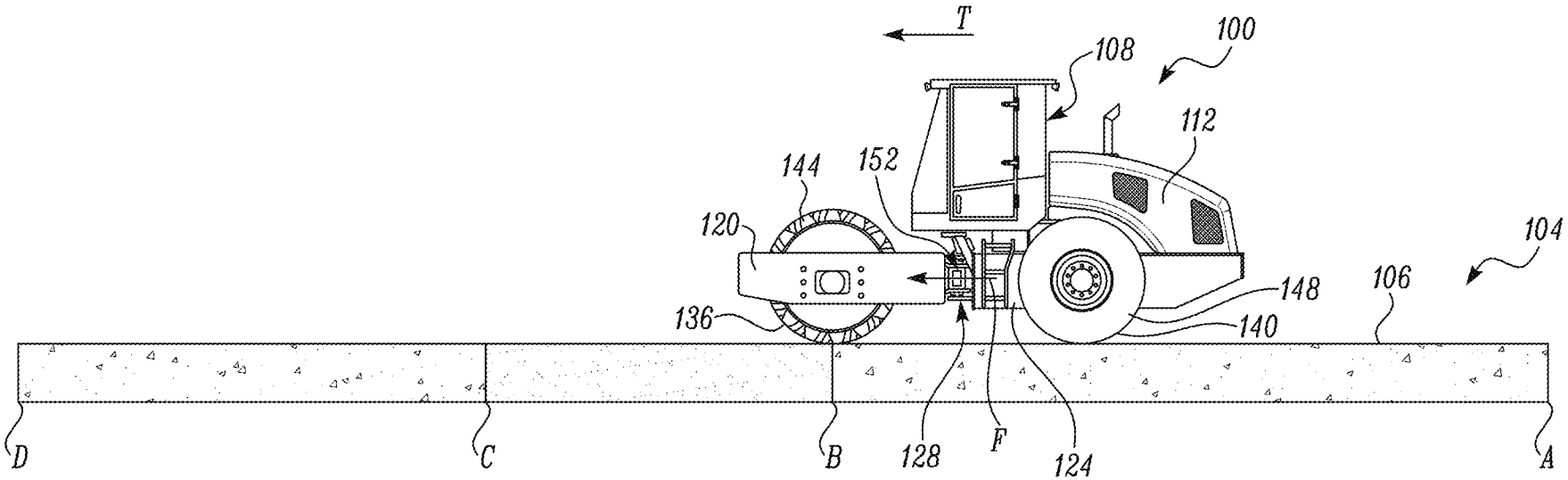

Further, the compactor 100 moves forward, along the travel direction, T, to a location at which the first traction unit 136 is at point 'B', as shown in FIG. 4. At this stage, the force sensor 152 may detect a non-zero value (e.g., the first non-zero value) of the force, F, transferred between the first frame 120 and the second frame 124 through the articulated joint 128, and transmits a signal indicative of the first non-zero value of the force, F, to the controller 156. In response to the first non-zero value of the force, F, the controller 156 may determine that the stiffness of a region (i.e., first region) in rolling engagement with the first traction unit 136 is different from the stiffness of a region (i.e., second region) in rolling engagement with the second traction unit 140.

Simultaneously, the controller 156 may determine the compaction levels of the regions in rolling engagement with their corresponding first traction unit 136 and the second traction unit 140, i.e., the first compaction level, $C_1$, of the first region and the second compaction level $C_2$, of the second region, based on the first non-zero value of the force, F. The controller 156 may obtain the first parameter indicative of the current drive power, $P_1$, of the first traction unit 136, and the second parameter indicative of a current drive power, $P_2$, of the second traction unit 140. Based on the first parameter, the second parameter, and the first non-zero value of the force, F, the controller 156 may calculate the first machine drive power, $MDP_1$, required to propel the first traction unit 136 over the first region (of the work surface 106) and the second machine drive power, $MDP_2$, required to propel the second traction unit 140 over the second region (of the work surface 106). Based on the first machine drive power, $MDP_1$, and the second machine drive power, $MDP_2$, the controller 156 may estimate the first compaction level, $C_1$, of the first region and the second compaction level $C_2$, of the second region. At the current stage, the controller 156 may compare the first compaction level, $C_1$, of the first region and the second compaction level $C_2$, of the second region to determine that the stiffness of the first region (in rolling engagement with the first traction unit 136, at point 'B') is lower than the stiffness of the second (in rolling engagement with the second traction unit 140).

Further, the compactor 100 moves forward, along the travel direction, T, to a location at which the first traction unit 136 is at point 'C', as shown in FIG. 5. At this stage, the force sensor 152 may detect a non-zero value (e.g., the second non-zero value) of the force, F, transferred between the first frame 120 and the second frame 124 through the articulated joint 128, and transmits a signal indicative of the second non-zero value of the force, F, to the controller 156. In response to the second non-zero value of the force, F, the controller 156 may determine that the stiffness of a region (i.e., first region) in rolling engagement with the first traction unit 136 is different from the stiffness of a region (i.e., second region) in rolling engagement with the second traction unit 140.

Simultaneously, the controller 156 may determine the compaction levels of the regions in rolling engagement with their corresponding first traction unit 136 and the second traction unit 140, i.e., the first compaction level, $C_1$, of the first region and the second compaction level $C_2$, of the second region, based on the second non-zero value of the force, F. For that, the controller 156 may obtain the first parameter indicative of the current drive power, $P_1$, of the first traction unit 136, and the second parameter indicative of a current drive power, $P_2$, of the second traction unit 140. Based on the first parameter, the second parameter, and the second non-zero value of the force, F, the controller 156 may calculate the first machine drive power, $MDP_1$, required to propel the first traction unit 136 over the first region (of the work surface 106) and the second machine drive power, $MDP_2$, required to propel the second traction unit 140 over the second region (of the work surface 106). Based on the first machine drive power, $MDP_1$, and the second machine drive power, $MDP_2$, the controller 156 may estimate the first compaction level, $C_1$, of the first region and the second compaction level $C_2$, of the second region. At the current stage, the controller 156 may compare the first compaction level, $C_1$, of the first region and the second compaction level $C_2$, of the second region to determine that the stiffness of the first region (in rolling engagement with the first traction unit 136, at point 'B') is greater than the stiffness of the second (in rolling engagement with the second traction unit 140).

The controller 156 may further receive the location of the rolling engagement of the first traction unit 136 with the first region of the work surface 106. Further, the controller 156 may calculate the location of the rolling engagement of the second traction unit 140 with the second region of the work surface 106. Based on the first compaction level, $C_1$, the second compaction level, $C_2$, and the location of the first traction unit 136, and the second traction unit 140, the controller 156 may generate a stiffness map which may indicate the first region as harder region with respect to the second region. The controller 156 may display the stiffness map on the display 160 in the operator station 108.

The present disclosure may be configured to accurately map the different regions of the work surface 106 having different compaction levels or stiffness. Positioning the force sensor 152, at the articulated joint 128 (connecting the first frame 120 to the second frame 124 of the compactor 100), enables measurement of force, F, transferred between the first frame 120 and the second frame 124. Determination of force, F, at the articulated joint 128 enables determination of the machine drive power, $MDP_1$, of the first traction unit 136 (coupled to the first frame 120) and the machine drive power, $MDP_2$, of the second traction unit 140 (coupled to the second frame 124). By separately determining the machine drive powers $MDP_1$ and $MDP_2$ for the first traction unit 136 and the second traction unit 140, respectively, the system 150 facilitates the determination of the first compaction level, $C_1$, for the first region beneath the first traction unit 136 and the compaction level, $C_2$, for the second region beneath the second traction unit 140. By determining the compaction levels of regions beneath the first traction unit 136 and the second traction unit 140, the system facilitates accurate mapping of the work surface 106 that may have different compaction levels or stiffness along its expanse.

It will be apparent to those skilled in the art that various modifications and variations can be made to the method and/or system of the present disclosure without departing from the scope of the disclosure. Other embodiments will be apparent to those skilled in the art from consideration of the specification and practice of the method and/or system disclosed herein. It is intended that the specification and examples be considered as exemplary only, with a true scope of the disclosure being indicated by the following claims and their equivalent.

What is claimed is:

1. A system for determining compaction of a work surface, the system comprising:

a first frame;

a second frame pivotally coupled to the first frame at an articulated joint;

a first traction unit operatively coupled to the first frame and configured to compact the work surface via rolling engagement with the work surface;

a second traction unit operatively coupled to the second frame and configured to propel the second frame over the work surface via rolling engagement with the work surface;

a force sensor positioned at the articulated joint and configured to measure a force transferred between the first frame and the second frame through the articulated joint; and a controller configured to:

determine, based on the force, a first compaction level of a first region of the work surface in rolling engagement with the first traction unit and a second compaction level of a second region of the work surface in rolling engagement with the second traction unit; and generate a stiffness map for the work surface based on the first compaction level and the second compaction level, wherein the stiffness map enables a user to identify at least one of the first region or the second region to perform work on the at least one of the first region or the second region.

2. The system of claim 1, wherein to determine the first compaction level and the second compaction level, the controller is configured to:

obtain a first parameter indicative of a first current drive power of the first traction unit and a second parameter indicative of a second current drive power of the second traction unit;

calculate a first machine drive power to propel the first traction unit over the first region of the work surface and a second machine drive power to propel the second traction unit over the second region of the work surface based on the force, the first parameter, and the second parameter; and estimate the first compaction level and the second compaction level based on the first machine drive power and the second machine drive power, respectively.

3. The system of claim 2, wherein the first compaction level and the second compaction level are determined when the first current drive power of the first traction unit is equal to the second current drive power of the second traction unit.

4. The system of claim 3, wherein the first compaction level indicates a first stiffness of the first region and wherein the second compaction level indicates a second stiffness of the second region, and wherein the controller is configured to determine the first stiffness of the first region equal to the second stiffness of the second region in response to a zero value of the force transfer between the first frame and the second frame.

5. The system of claim 3, wherein the first compaction level indicates a first stiffness of the first region and wherein the second compaction level indicates a second stiffness of the second region, and wherein the controller is configured to determine that the first stiffness of the first region is lower than the second stiffness of the second region in response to a first non-zero value of the force transferred between the first frame and the second frame.

6. The system of claim 5, wherein the controller is configured to determine that the first stiffness of the first region is greater than the second stiffness of the second region in response to a second non-zero value of the force transferred between the first frame and the second frame, and wherein the second non-zero value is different from the first non-zero value.

7. The system of claim 1, wherein the controller is configured to:

receive an input indicative of a location of the rolling engagement of the first traction unit with the first region of the work surface, wherein the stiffness map is further generated based on the input.

8. A compactor, comprising:

a power source configured to power movement of the compactor on a work surface for compaction of the work surface;

a system for determining the compaction of the work surface, the system comprising:

a first frame;

a second frame pivotally coupled to the first frame at an articulated joint, the second frame configured to support the power source;

a first traction unit operatively coupled to the first frame and configured to compact the work surface via rolling engagement with the work surface;

a second traction unit operatively coupled to the second frame and configured to propel the second frame over the work surface via rolling engagement with the work surface;

a force sensor positioned at the articulated joint and configured to measure a force transferred between the first traction unit and the second traction unit through the articulated joint; and a controller configured to:

determine, based on the force, a first compaction level of a first region of the work surface in rolling engagement with the first traction unit and a second compaction level of a second region of the work surface in rolling engagement with the second traction unit; and generate a stiffness map for the work surface based on the first compaction level and the second compaction level, wherein the stiffness map enables a user to identify at least one of the first region or the second region to perform work on the at least one of the first region or the second region.

9. The compactor of claim 8, wherein to determine the first compaction level of the first region and the second compaction level of the second region, the controller is configured to:

obtain a first parameter indicative of a first current drive power of the first traction unit and a second parameter indicative of a second current drive power of the second traction unit;

calculate a first machine drive power to propel the first traction unit over the first region of the work surface and a second machine drive power to propel the second traction unit over the second region of the work surface based on the force, the first parameter, and the second parameter; and estimate the first compaction level and the second compaction level based on the first machine drive power and the second machine drive power, respectively.

10. The compactor of claim 9, wherein the first compaction level and the second compaction level are determined when the first current drive power of the first traction unit is equal to the second current drive power of the second traction unit.

11. The compactor of claim 10, wherein the first compaction level indicates a first stiffness of the first region and wherein the second compaction level indicates a second stiffness of the second region, and wherein the controller is configured to determine that the first stiffness of the first region is equal to the second stiffness of the second region in response to a zero value of the force transfer between the first frame and the second frame.

12. The compactor of claim 10, wherein the first compaction level indicates a first stiffness of the first region and wherein the second compaction level indicates a second stiffness of the second region, and wherein the controller is configured to determine that the first stiffness of the first region is lower than the second stiffness of the second region in response to a first non-zero value of the force transferred between the first frame and the second frame.

13. The compactor of claim 12, wherein the controller is configured to determine that the first stiffness of the first region is greater than the second stiffness of the second region in response to a second non-zero value of the force transferred between the first frame and the second frame, and wherein the second non-zero value is different from the first non-zero value.

14. The compactor of claim 8, wherein the controller is configured to:

receive an input indicative of a location of the rolling engagement of the first traction unit with the first region of the work surface, wherein the stiffness map is further generated based on the input.

15. A method for determining compaction of a work surface using a first frame, a second frame pivotally coupled to the first frame at an articulated joint, a first traction unit operatively coupled to the first frame and configured to compact the work surface via rolling engagement with the work surface, and a second traction unit operatively coupled to the second frame and configured to propel the second frame over the work surface via rolling engagement with the work surface, the method comprising;

measuring, by a force sensor positioned at the articulated joint, a force transferred between the first frame and the second frame through the articulated joint;

determining, by a controller, based on the force, a first compaction level of a first region of the work surface in rolling engagement with the first traction unit and a second compaction level of a second region of the work surface in rolling engagement with the second traction unit; and generating, by the controller, a stiffness map for the work surface based on the first compaction level and the second compaction level, wherein the stiffness map enables a user to identify at least one of the first region or the second region to perform work on the at least one of the first region or the second region.

16. The method of claim 15, wherein determining the first compaction level and the second compaction level includes:

obtaining, by the controller, a first parameter indicative of a first current drive power of the first traction unit and a second parameter indicative of a second current drive power of the second traction unit;

calculating, by the controller, a first machine drive power to propel the first traction unit over the first region of the work surface and a second machine drive power to propel the second traction unit over the second region of the work surface based on the force, the first parameter, and the second parameter; and estimating, by the controller, the first compaction level and the second compaction level based on the first machine drive power and the second machine drive power, respectively.

17. The method of claim 16, wherein the first compaction level and the second compaction level are determined when the first current drive power is equal to the second current drive power.

18. The method of claim 17, wherein the first compaction level indicates a first stiffness of the first region and wherein the second compaction level indicates a second stiffness of the second region, and, the method further comprising:

determining, by the controller, that the first stiffness of the first region is equal to the second stiffness of the second region in response to a zero value of the force transfer between the first frame and the second frame.

19. The method of claim 17, wherein the first compaction level indicates a first stiffness of the first region and wherein the second compaction level indicates a second stiffness of the second region, and, the method further comprising:

determining, by the controller, that the first stiffness of the first region is lower than the second stiffness of the second region in response to a first non-zero value of the force transferred between the first frame and the second frame; and determining, by the controller, that the first stiffness of the first region is greater than the second stiffness of the second region in response to a second non-zero value of the force transferred between the first frame and the second frame, wherein the second non-zero value is different from the first non-zero value.

20. The method of claim 15, including:

receiving, by the controller, an input indicative of a location of the rolling engagement of the first traction unit with the first region of the work surface, wherein the stiffness map is further generated based on the input.

* * * * *